US006896560B2

(12) United States Patent
Nakamura et al.

(10) Patent No.: US 6,896,560 B2
(45) Date of Patent: May 24, 2005

(54) CONNECTOR WITH RETAINER HAVING FRONT WALL AND REINFORCEMENT

(75) Inventors: Hideto Nakamura, Yokkaichi (JP); Naoya Kurimoto, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/695,464

(22) Filed: Oct. 28, 2003

(65) Prior Publication Data

US 2004/0092173 A1 May 13, 2004

(30) Foreign Application Priority Data

Oct. 30, 2002 (JP) ..... 2002-316519

(51) Int. Cl.[7] ..... H01R 13/514; H01R 13/40; H01R 13/625

(52) U.S. Cl. ..... 439/752; 439/603; 439/345

(58) Field of Search ..... 439/752, 595, 439/603, 345, 357, 304

(56) References Cited

U.S. PATENT DOCUMENTS 5,183,418 A 2/1993 Yamanashi et al.
5,203,722 A 4/1993 Kinoshita
5,439,397 A 8/1995 Yamanashi et al.
5,569,055 A 10/1996 Yamanashi et al.
6,200,172 B1 3/2001 Konoya et al.
6,716,069 B2 * 4/2004 Nakamura et al. ..... 439/752
6,769,934 B2 * 8/2004 Nakamura et al. ..... 439/595
2001/0016457 A1 8/2001 Taguchi et al.
2002/0197915 A1 * 12/2002 Mase et al. ..... 439/752
2003/0060075 A1 * 3/2003 Nakamura et al. ..... 439/345

* cited by examiner

*Primary Examiner*—Chandrika Prasad
(74) *Attorney, Agent, or Firm*—Gerald E. Hespos; Anthony J. Casella

(57) ABSTRACT

A retainer (40) has two supports (44) that extend forward from opposite left and right walls of a retainer main body (41) and a front wall (46) spans between the front edges of the two supports (44). The front wall (46) has a reinforcing portion (52) that projects substantially normal to a wall of the front wall (46) and extends transversely. The reinforcing portion (52) prevents a curved deformation of the front wall (46) along forward and backward directions.

16 Claims, 12 Drawing Sheets

CONNECTOR WITH RETAINER HAVING FRONT WALL AND REINFORCEMENT

BACKGROUND OF THE INVENTION

1. Field of the Invention

The invention relates to a connector that locks terminal fittings in a housing.

2. Description of the Related Art

U.S. Pat. No. 5,439,397 discloses a connector with a housing that has opposite front and rear ends. The housing has cavities that extend from the front end to the rear end and locks that extend into the cavities. Female terminal fittings are inserted into the cavities from the rear and are locked by the locks. Insertion openings extend into the cavities from the front and allow the insertion of tabs of male terminal fittings. Mold-removal spaces also extend into the front of the housing so that the locks can be molded. The insertion holes and the mold-removal spaces communicate with each other.

The mold-removal spaces are narrower than the insertion openings for a normal size connector. Thus, slanted guide surfaces for guiding the tabs into the insertion openings can be formed at the upper or lower edges of the insertion openings, thereby taking advantage of a difference in these widths.

The locks for a miniaturized connector must be sufficiently wide to achieve the necessary strength even through the terminal fittings and cavities are narrow. Thus, the mold-removal spaces must be at least as wide as the insertion openings. In such a case, slanted guides cannot be formed at the edges of the insertion openings toward the mold-removal spaces, and the tabs may be inserted into the mold-removal spaces instead of into the cavities.

As a countermeasure, U.S. Pat. No. 5,203,702 discloses a retainer that is mountable into the housing in a direction normal to the inserting direction of the terminal fittings to lock the terminal fittings. The retainer has a front wall that extends along the front end of the housing. The front wall of the retainer has through holes that align with the insertion openings of the housing. Slanted guide surfaces are formed at the opening edges of the through holes. In this way, the slanted guide surfaces can be provided in areas corresponding to the mold-removal spaces.

The retainer is accommodated in a mount hole at a middle position of the housing with respect to forward and backward directions and is mountable normal to the inserting direction of the terminal fittings. The retainer also has a front wall that extends along the front surface of the housing. A main body of the retainer and the front wall are spaced apart along forward and backward directions, and hence a support is needed to support the front wall. The support has elongated left and right outer walls that support opposite left and right edges of the front wall. However, portions of the front wall between the edges may deform and curve along forward and backward directions.

The present invention was developed in view of the above problem and an object thereof is to prevent the deformation of a front wall of a retainer.

SUMMARY OF THE INVENTION

The invention relates to a connector that has a housing with opposite front and rear ends. Cavities extend into the rear end of the housing and are dimensioned to receive terminal fittings. Insertion openings extend into the front end and communicate with the cavities. A retainer is mountable into the housing for locking the terminal fittings in the cavities. The retainer has a main body with locks that engage the terminal fittings. The retainer has a front wall supported substantially along the front-end surface of the housing. Through holes are formed in the front wall at locations that correspond to the insertion openings. The front wall has at least one reinforcement that projects at an angle, and preferably substantially normal to a surface of the front wall and that extends in a transverse direction. The reinforcement prevents the front wall from curving along forward and backward directions.

The retainer may have two supports extending from the opposite lateral walls of the main body. The front wall preferably spans the front edges of the supports substantially along the front surface of the housing.

At least one of the left and right edges of the reinforcement preferably is coupled to the support. Thus, displacements of the reinforcement are restricted, and deformation of the front wall is prevented more securely.

Cavities arranged along an outer wall of the housing preferably have the respective lock at a side opposite from the outer wall.

An outer wall at a front end of the housing preferably is cut-away, and the reinforcement preferably is accommodated in the cut-away portion. Thus, the reinforcement does not project out from the outer surface of the housing. Further, the reinforcement does not interfere with the locks because the locks are at the side opposite from the cut-away portion.

A bulge preferably is formed to increase the thicknesses of the front wall and the reinforcement. The bulge preferably extends in a transverse direction and is formed at a corner where the front wall and the reinforcement meet. Thus, the front wall and the reinforcement have a higher bending strength. The housing preferably has an accommodating portion for accommodating the bulge.

The accommodating portion preferably communicates with front ends of the cavities, and the terminal fittings are held at their front-limit positions in the cavities by contacting the bulge in the accommodating portion.

The bulge for holding the terminal fittings at their front-limit positions and the locks for locking the terminal fittings always are spaced by a specified distance along forward and backward directions because both are formed in the retainer. Thus, the terminal fittings that are held at their front-limit positions by the bulge do not shake forward and back with respect to the retainer even if the retainer shakes along forward and back with respect to the housing due.

The housing and the front wall may have guides. Thus, the front wall slides along the front-end surface of the housing as the retainer is moved.

The through holes of the retainer preferably align with the insertion openings and the front wall of the retainer closes the mold-removal spaces when the retainer is in a locking position for locking the terminal fittings,.

These and other features and advantages of the invention will be more apparent after reading the following description of preferred embodiments and accompanying drawings. Even though embodiments are described separately, single features may be combined to additional embodiments.

DETAILED DESCRIPTION OF THE PREFERRED EMBODIMENTS

Figure 2:
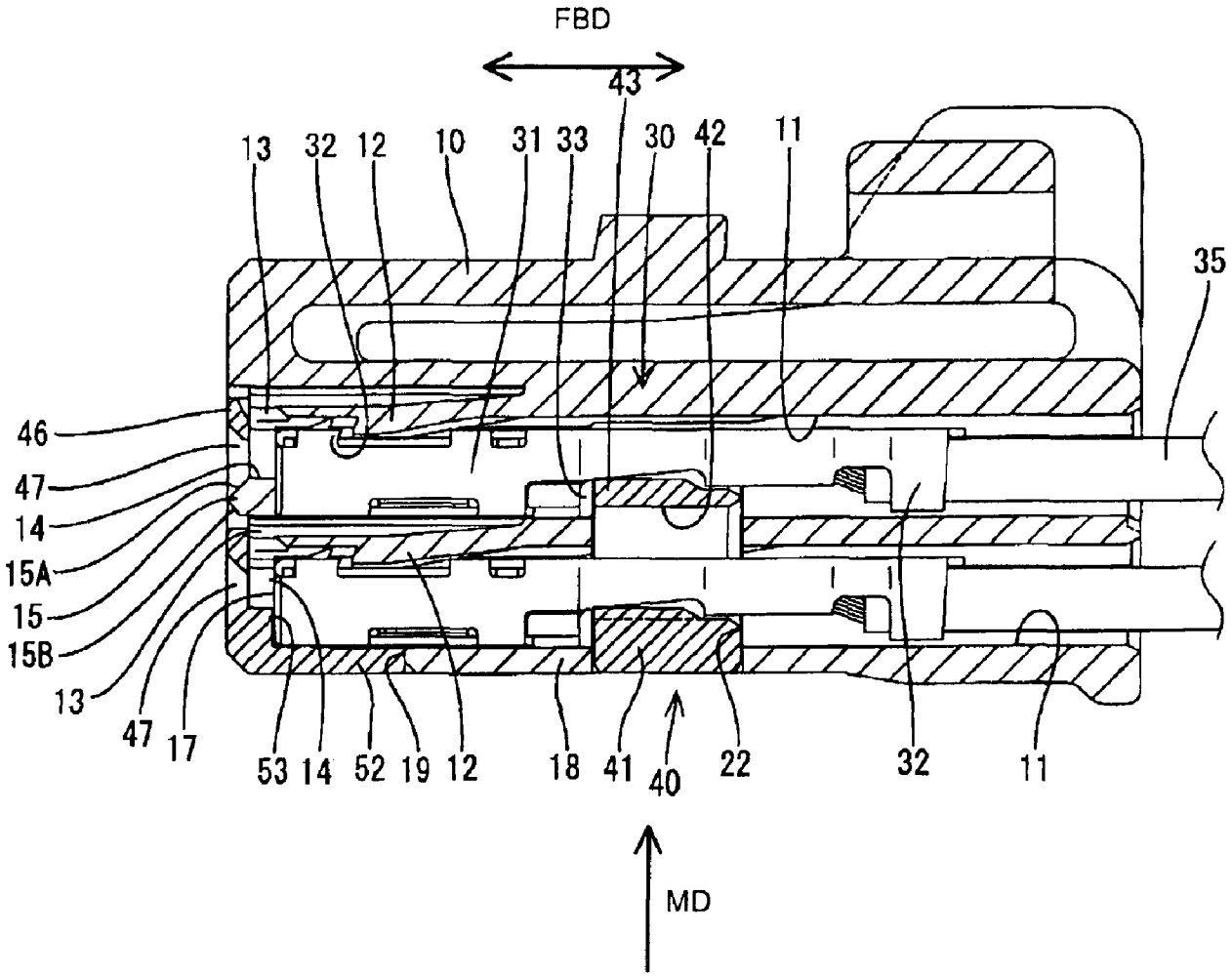
FIG. 2 is a section showing the state where the retainer is fully locked.

A connector according to the invention includes a housing 10 with opposite front and rear ends. The front end is to the left in FIG. 2 and is configured for mating with an unillustrated mating connector. Cavities 11 are arranged at specified intervals in upper and lower stages in the housing 10 so that the same numbers of cavities 11 are arrayed at each stage. The cavities 11 are narrow and long along forward and backward directions and are open in the front and rear ends of the housing 10. The respective cavities 11 at the upper stage align vertically with those at the lower stage.

A lock 12 is cantilevered forwardly from a ceiling wall of each cavity 11. The upper surface of the lock 12 of each cavity 11 at the lower stage faces the corresponding cavity 11 at the upper stage. Mold-removal spaces 13 are formed by removing a mold for forming the locks 12 and extend from the respective locks 12 to the front end of the housing 10. The front-end surface of the housing 10 is formed with substantially rectangular insertion openings 14 for allowing insertion of tabs of male terminal fittings (not shown) into the cavities 11 from the front. The insertion openings 14 are narrower than the mold-removal spaces 13 and the cavities 11, and are located above the bottom walls of the cavities 11. The respective insertion openings 14 communicate with the mold-removal spaces 13 located above the insertion openings 14.

A housing-side guide 15 projects at the front-end surface of the housing 10 and extends substantially along the bottom side of the opening edge of the insertion opening 14 of each cavity 11 at the upper stage. The guide 15 has a guide surface 15A sloped down to the front from the bottom edge of the insertion opening 14. The guide 15 also has an introducing surface 15B sloped down to the back toward the upper side of the opening edge of the corresponding mold-removal space 13 at the lower stage. The left and right surfaces of each guide 15 are at substantially the same positions as the left and right sides of the opening edge of the corresponding insertion opening 14 with respect to the transverse direction TD when viewed from the front, and the left and right surfaces of the guide 15 define substantially flat guiding surfaces 16.

A narrow accommodating portion 17 is formed over substantially the entire width at the bottom end of the front-end surface of the housing 10. The accommodating portion 17 communicates with the bottom edges of the insertion openings 14 of the cavities 11 at the lower stage, and the back end surface of the accommodating portion 17 is substantially at the same position as front walls of the cavities 11 along forward and backward directions FBD. Thus, the accommodating portion 17 exposes lower halves of the lower stage cavities 11 at the front-end surface of the housing 10.

A bottom wall 18 of the housing 10 defines bottom walls of the cavities 11 at the lower stage, and has a cut-away portion 19 at the front end of the housing 10. The cut-away portion 19 is open up to the front-end surface of the housing 10 and communicates with the accommodating portion 17. It should be noted that the bottom wall and the locks 12 are on surfaces substantially vertically opposed to each other in the cavities 11 at the lower stage.

Mounting recesses 20 are formed in the left and right outer surfaces of the housing 10 and open at the front-end surface and the bottom surface of the housing 10. Upper and lower locking projections 21 are formed in each mounting recess 20. A mount space 22 opens in the bottom surface of the housing 10 and the mounting recesses 20. The mount space 22 vertically penetrates the cavities 11 at the lower stage and communicates with the cavities 11 at the upper stage.

The connector also includes female terminal fittings 30 that can be inserted into the cavities 11. Each female terminal fitting 30 has a substantially rectangular tube 31 at its front end and a wire-crimping portion 32 at its rear end. A first engaging portion 33 is formed on the upper surface of the rectangular tube 31 for engaging the lock 12, and a second engaging portion 34 is formed at the rear bottom end of the rectangular tube 31. The wire-crimping portion 32 is configured for crimped, bent or folded connection with a wire 35.

The connector also has a retainer 40 with a main body 41 that is narrow and wide along a transverse direction TD and that can be accommodated in the mount space 22. The main body 41 has substantially rectangular terminal insertion holes 42 corresponding to the respective cavities 11 at the lower stage. Locking sections 43 are formed on the bottom surfaces of the respective terminal insertion holes 42 for engaging the female terminal fittings 30 inserted into the cavities 11 at the lower stage, and also are formed on the upper surface of the main body 41 for engaging the female terminal fittings 30 inserted into the cavities 11 at the upper stage.

Figure 4:
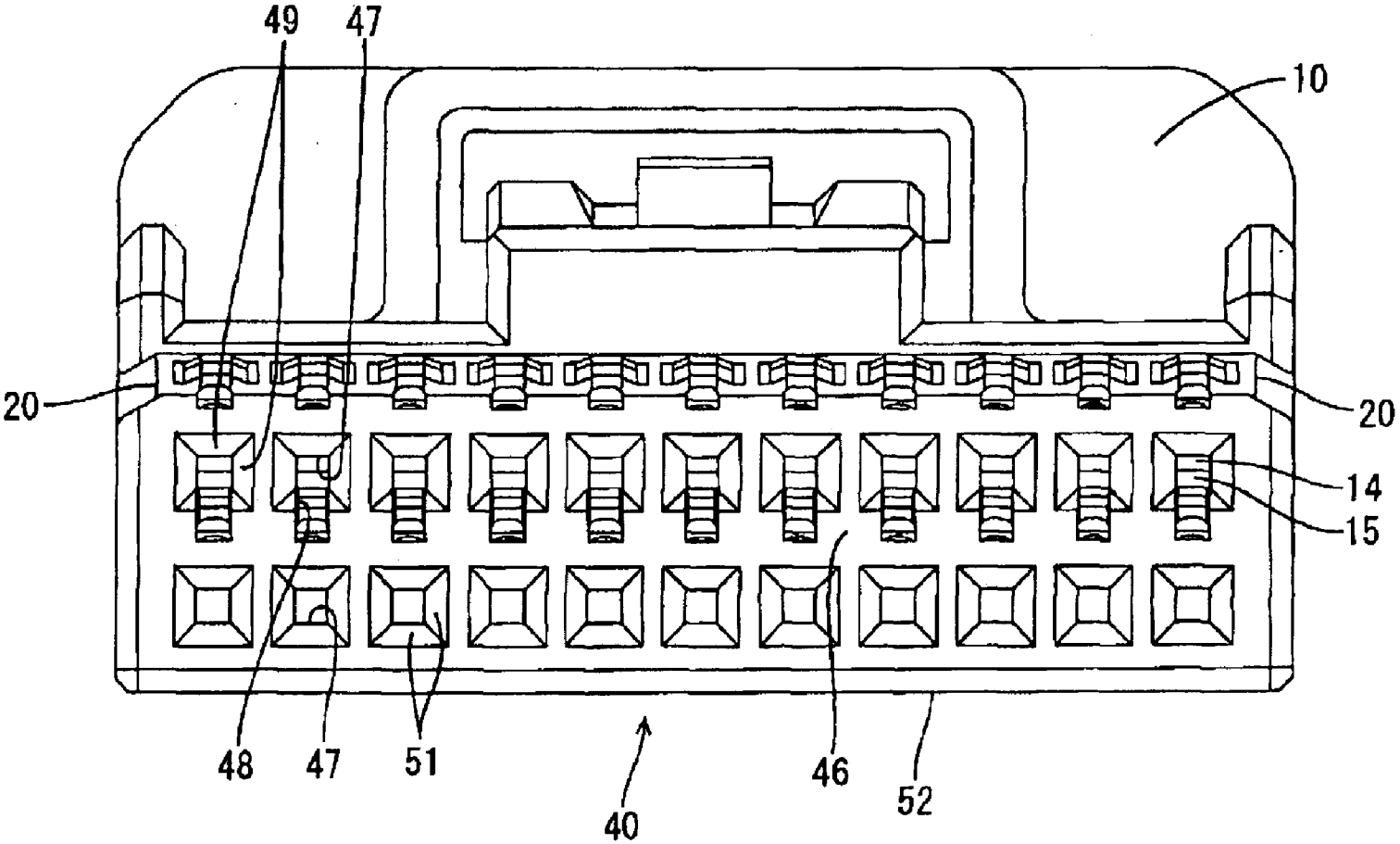
FIG. 4 is a front view showing a state where the retainer is partly locked.
Figure 5:
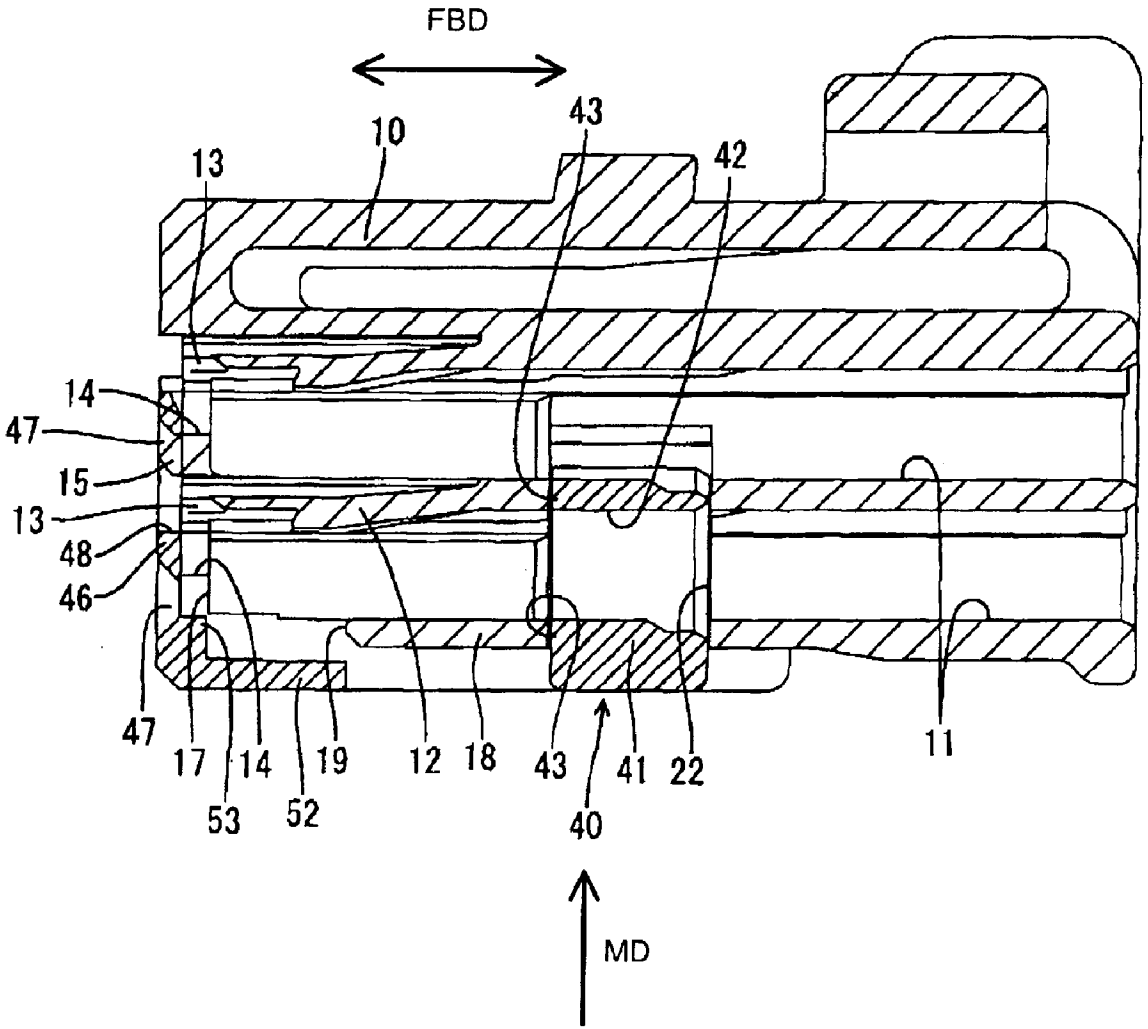
FIG. 5 is a section showing the partly locked retainer.
Figure 6A:
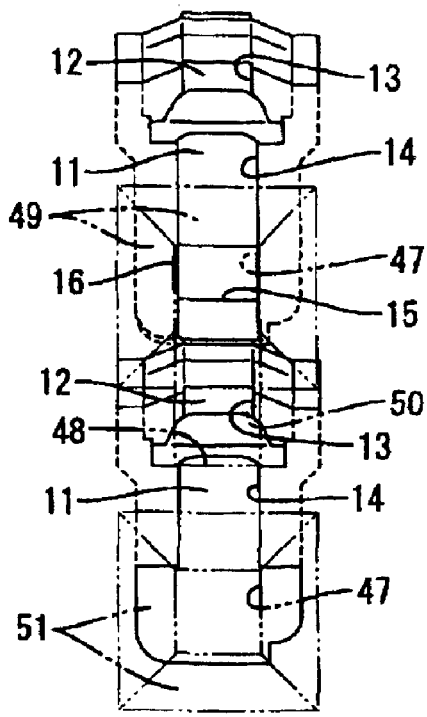
FIGS. 6(*a*) and 6(*b*) are front and sectional views showing the retainer partly locked.
Figure 6B:
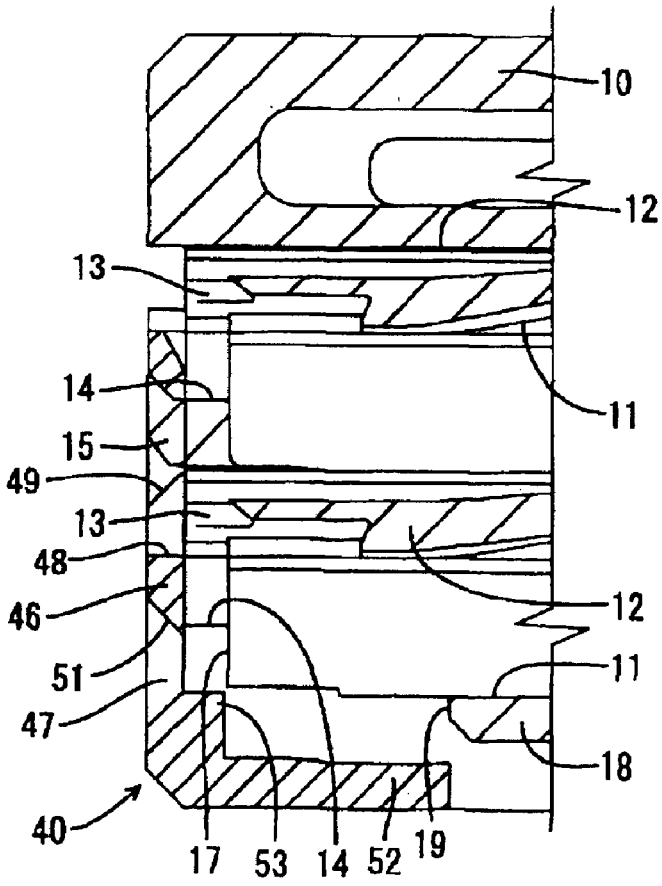

The retainer 40 has left and right supports 44 that extend vertically and in forward and backward directions FBD from left and right ends of the main body 41. A locking projection 45 is formed on the inner side surface of each support 44 and is engageable with the corresponding locking projections 21 of the housing 10. The supports 44 fit in the mounting recesses 20 when the retainer 40 is mounted on the housing 10 so that most of the main body 41 is accommodated in the mount space 22. Additionally, each locking projection 45 is engaged between the corresponding pair of locking projections 21. Thus, the retainer 40 can be held at a partial locking position where the terminal fittings 30 can be inserted into and withdrawn from the cavities 11 (see FIGS. 4 to 6).

Figure 1:
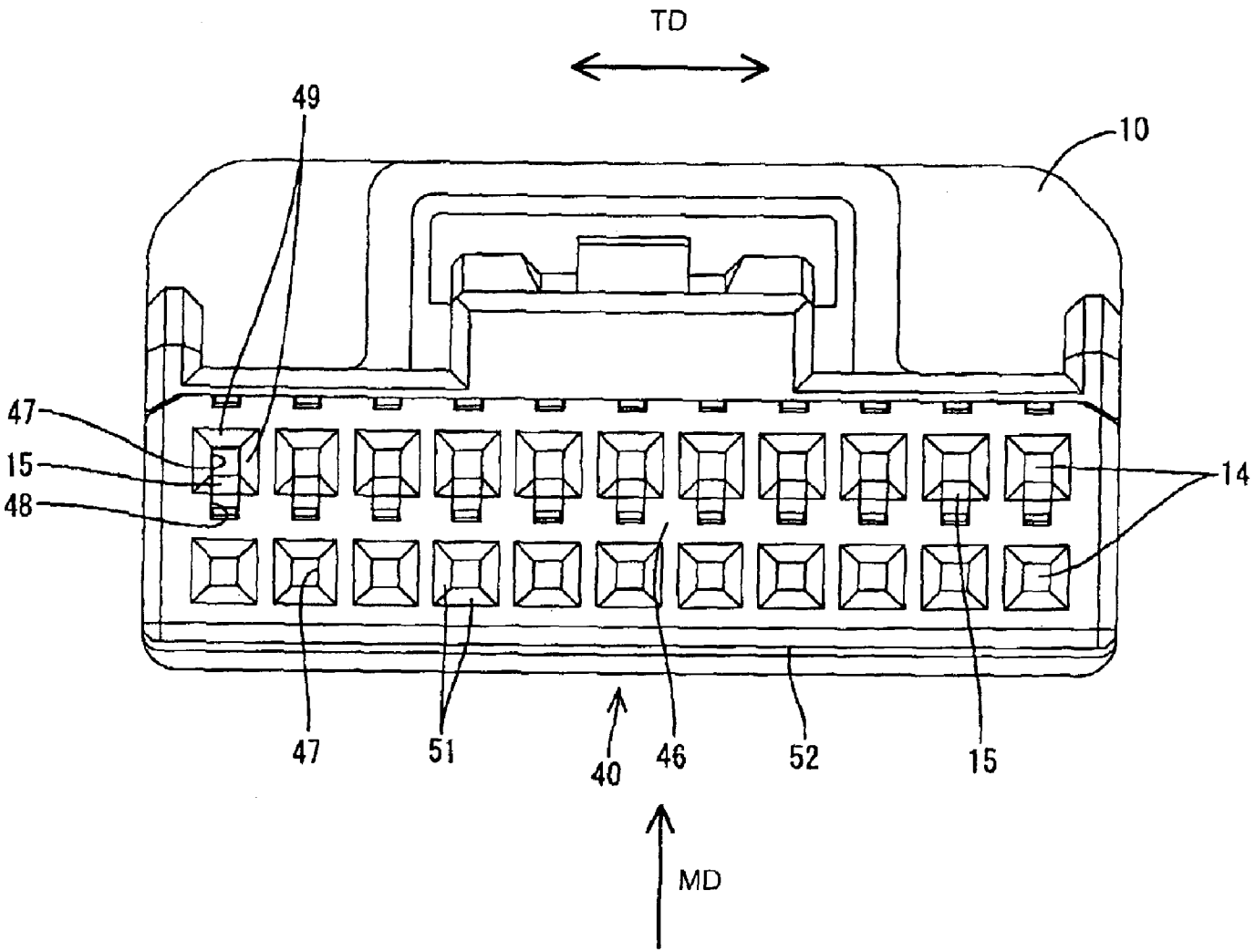
FIG. 1 is a front view of a connector according to the invention with a retainer fully locked.
Figure 3A:
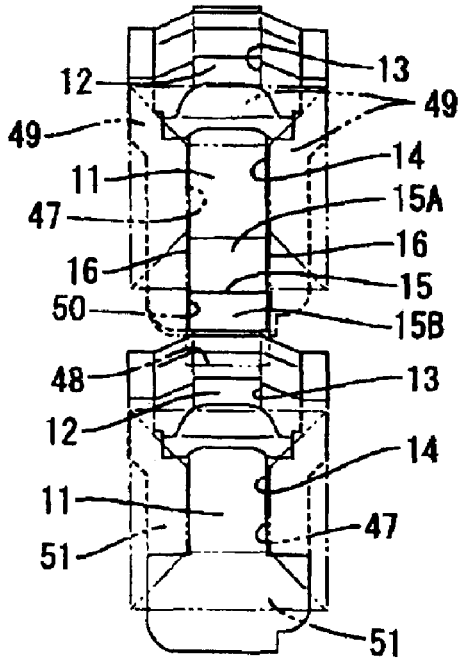
FIGS. 3(*a*) and 3(*b*) are front and sectional views showing the retainer fully locked.
Figure 3B:
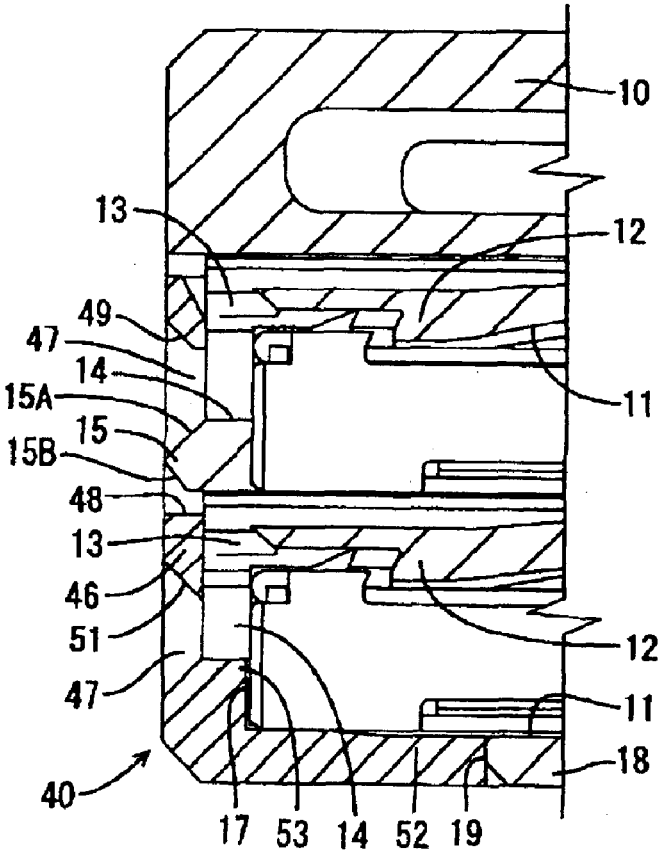

The retainer 40 can be moved in a mounting direction MD substantially perpendicular to the forward and backward directions FBD to a full locking position after the female terminal fittings 30 are inserted properly into the respective cavities 11. Thus, the retainer main body 41 is accommodated substantially completely in the mount space 22 and the respective locks 43 contact the second engaging portions 34 of the female terminal fittings 30 from behind. As a result the female terminal fittings 30 are locked. At this time, the supports 44 contact the upper edges of the mounting recesses 20 from below and the locking projections 45 engage the upper locking projections 21 to hold the retainer 40 at the full locking position (see FIGS. 1 to 3).

A substantially rectangular front wall 46 spans the front edges of the left and right supports 44. The front wall 46 is a substantially flat plate that slides in close contact with the front-end surface of the housing 10 when the retainer 40 is moved vertically along the mounting direction MD between the partial locking position and the full locking position. The front wall 46 has substantially rectangular through holes 47 that align with the respective insertion openings 14 when the retainer 40 is at the full locking position. Substantially rectangular jig insertion openings 48 penetrate the front wall 46 and face the mold-removal spaces 13 of the cavities 11 at the lower stage when the retainer 40 is at the partial locking position. The partial locking position is lower than the full locking position along the mounting direction MD. The width of the jig insertion openings 48 is substantially equal the width of the through holes 47, and the jig insertion openings 48 communicate with the through holes 47 corresponding to the cavities 11 at the upper stage. Tapered retainer-side guides 49 are formed along three sides of the opening edge of each through hole 47 corresponding to the cavity 11 at the upper stage excluding the lower side. The tapered retainer-side guides 49 communicate with the jig insertion opening 48. Left and right inner surfaces of each jig insertion opening 48 define substantially flat guiding surfaces 50 that slide in contact with the guiding surfaces 16 of the corresponding housing-side guide 15 of the housing 10. Retainer-side guides 51 are formed along all four sides of the opening edge of each through hole 47 corresponding to the cavity 11 at the lower stage.

A reinforcing wall 52 is formed at the bottom end of the front wall 46 and extends substantially horizontally back over substantially the entire width. The reinforcing wall 52 projects substantially at a right angle to the front wall 46, and the opposite left and right ends thereof are coupled to the bottom ends of the supports 44. The reinforcing wall 52 is accommodated in the cut-away portion 19 of the housing 10 when the retainer 40 is held at the full locking position. In this state, the lower surface of the reinforcing wall 52 is substantially flush with the lower surface of the bottom wall 18 of the housing 10, and the upper surface of the front end of the reinforcing wall 52 faces the front ends of the cavities 11 at the lower stage from below. In other words, the upper surface of the front end of the reinforcing wall 52 forms a part of the bottom walls of the cavities 11.

A bulge 53 is formed over substantially the entire width at an inner corner where the front wall 46 and the reinforcing wall 52 meet at right angles to increase the thicknesses of the front wall 46 and the reinforcing wall 52. The bulge 53 projects back from the front wall 46 and projects up from the reinforcing wall 52. The bulge 53 is accommodated in the accommodating portion 17 of the housing 10 and the rear surface of the bulge 53 faces the cavities 11 at the lower stage from the front when the retainer 40 is at the full locking position. Accordingly, the bulge 53 forms a part of the front walls of the cavities 11.

Figure 7:
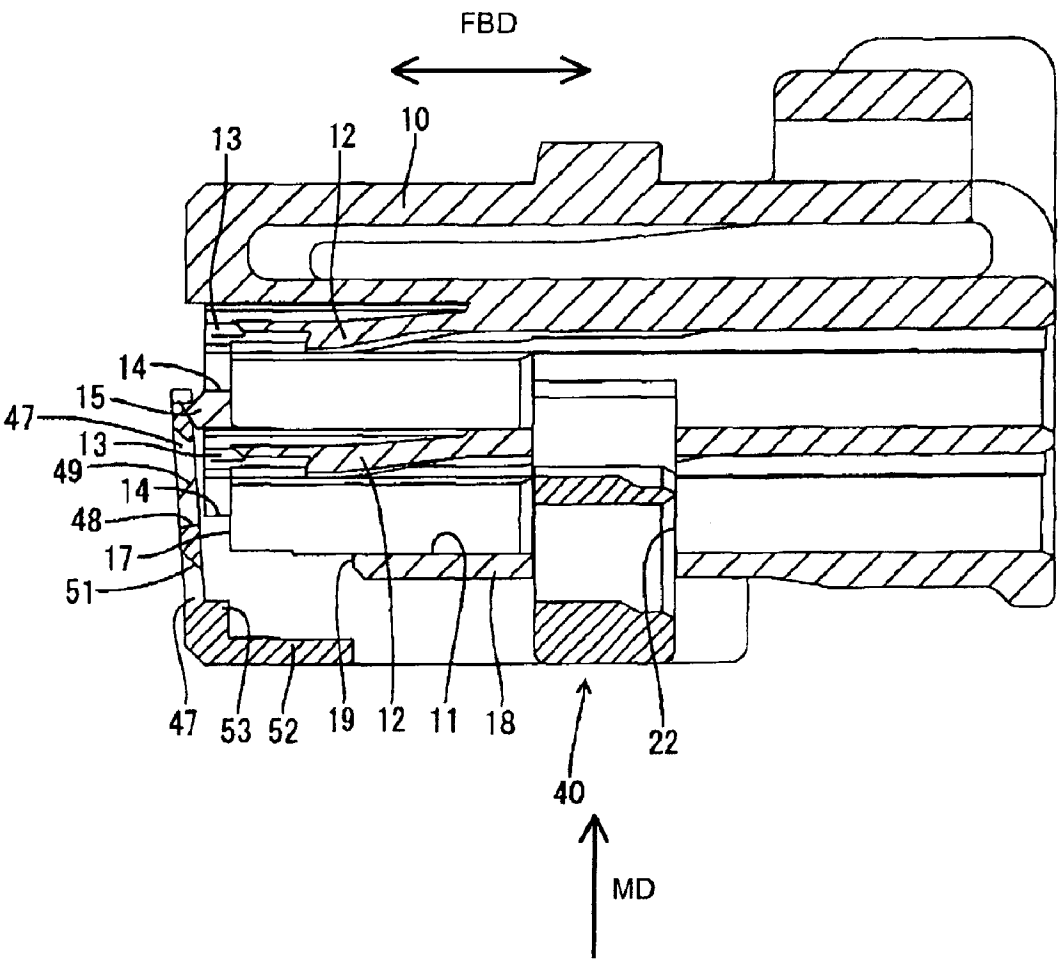
FIG. 7 is a section of an intermediate state of mounting the retainer.
Figure 8:
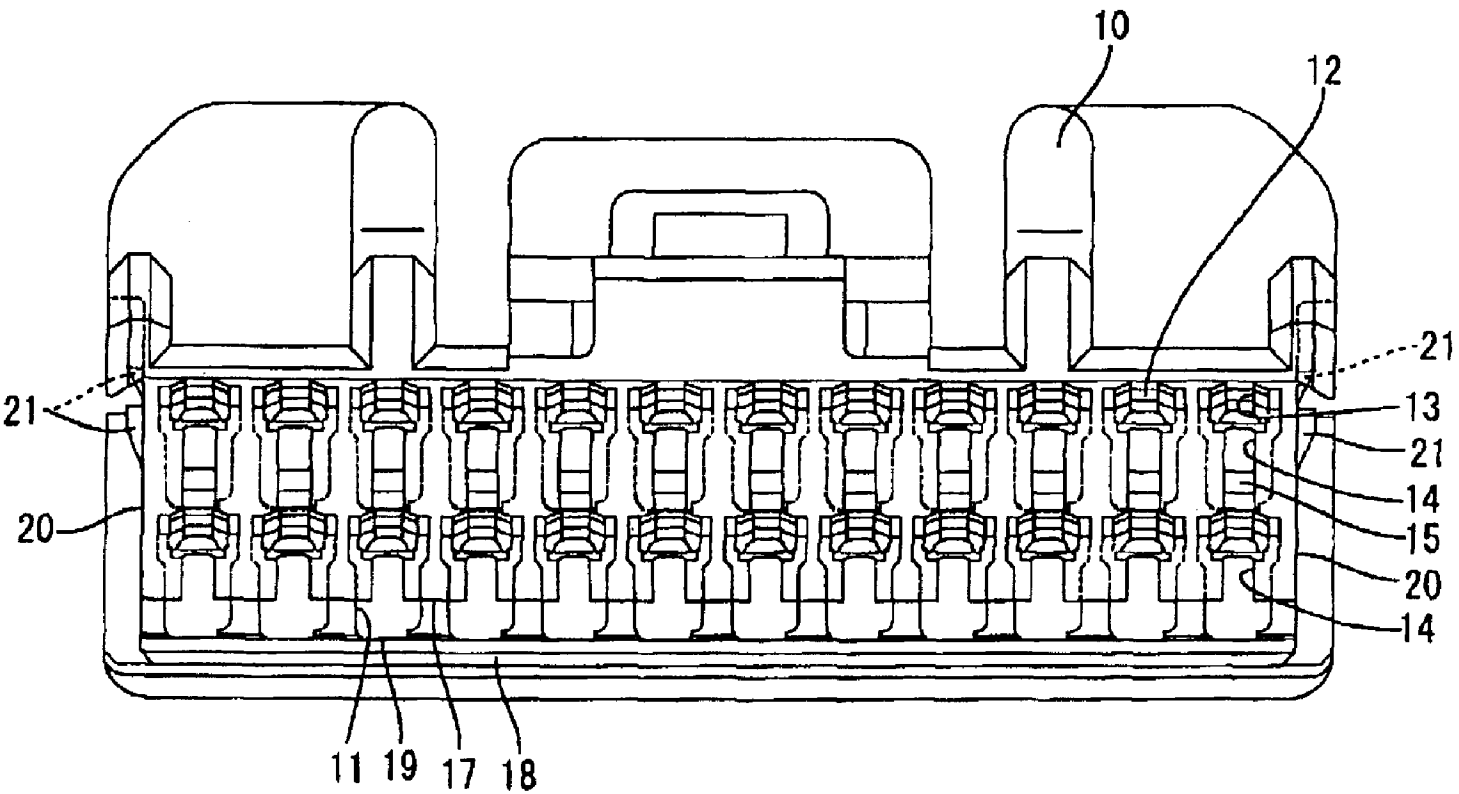
FIG. 8 is a front view of the housing.
Figure 9:
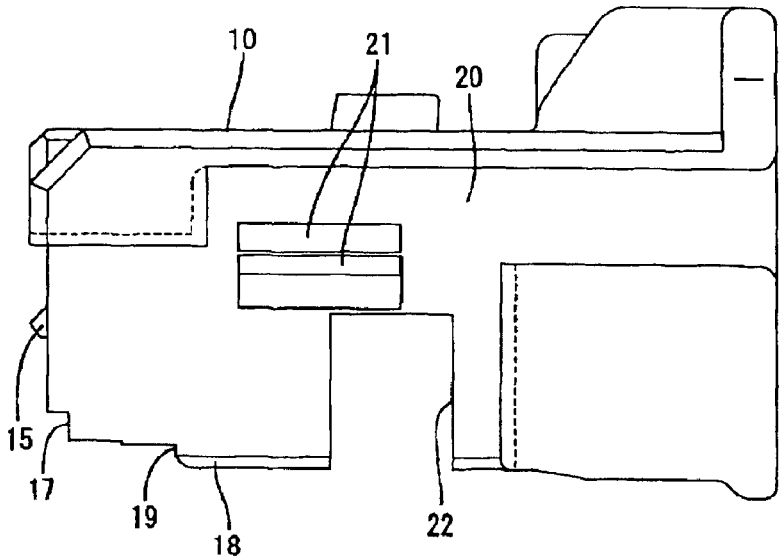
FIG. 9 is a side view of the housing.
Figure 10:
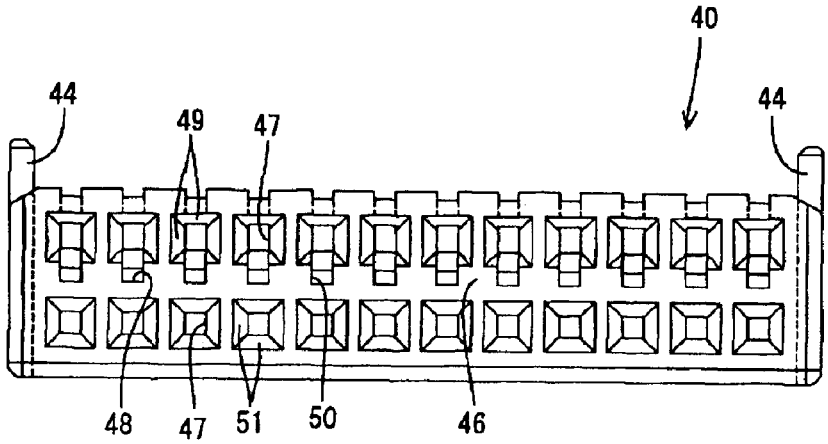
FIG. 10 is a front view of the retainer.
Figure 11:
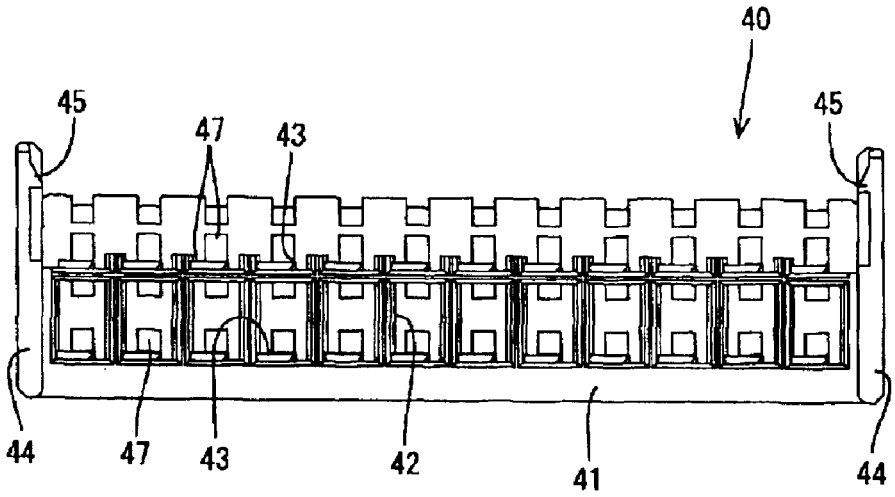
FIG. 11 is a rear view of the retainer.
Figure 12:
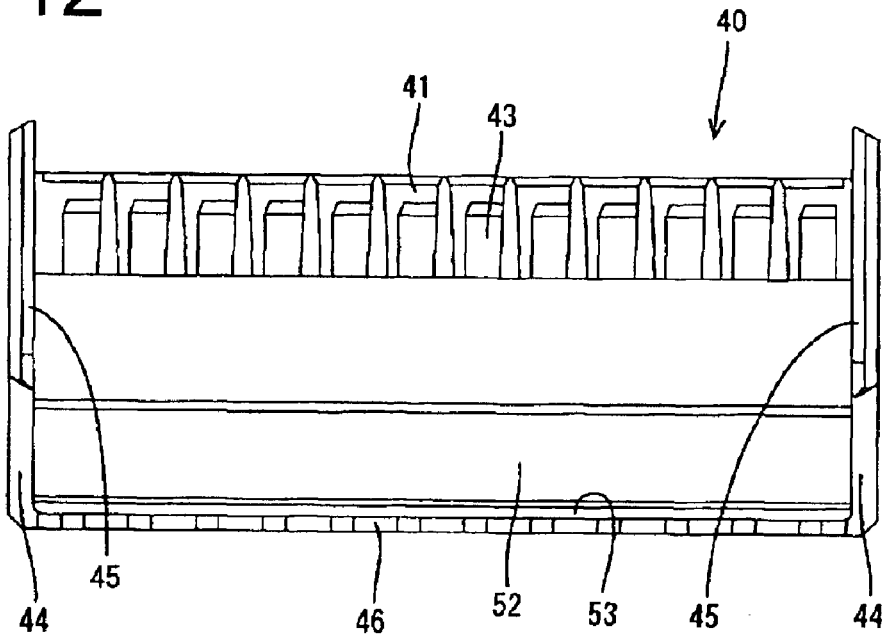
FIG. 12 is a plan view of the retainer.
Figure 13:
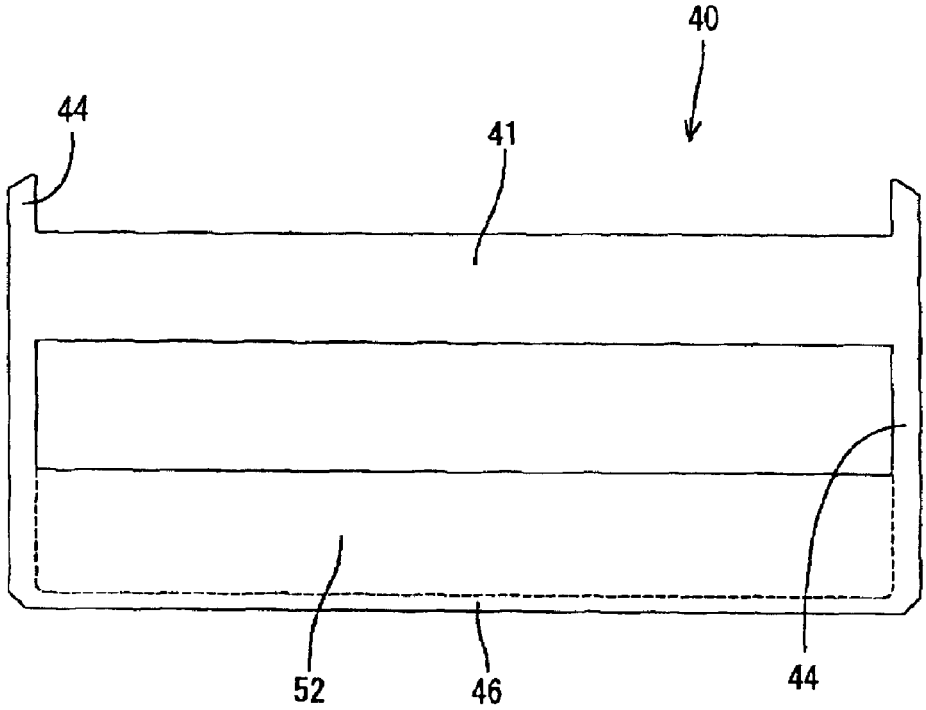
FIG. 13 is a section of the retainer.
Figure 14:
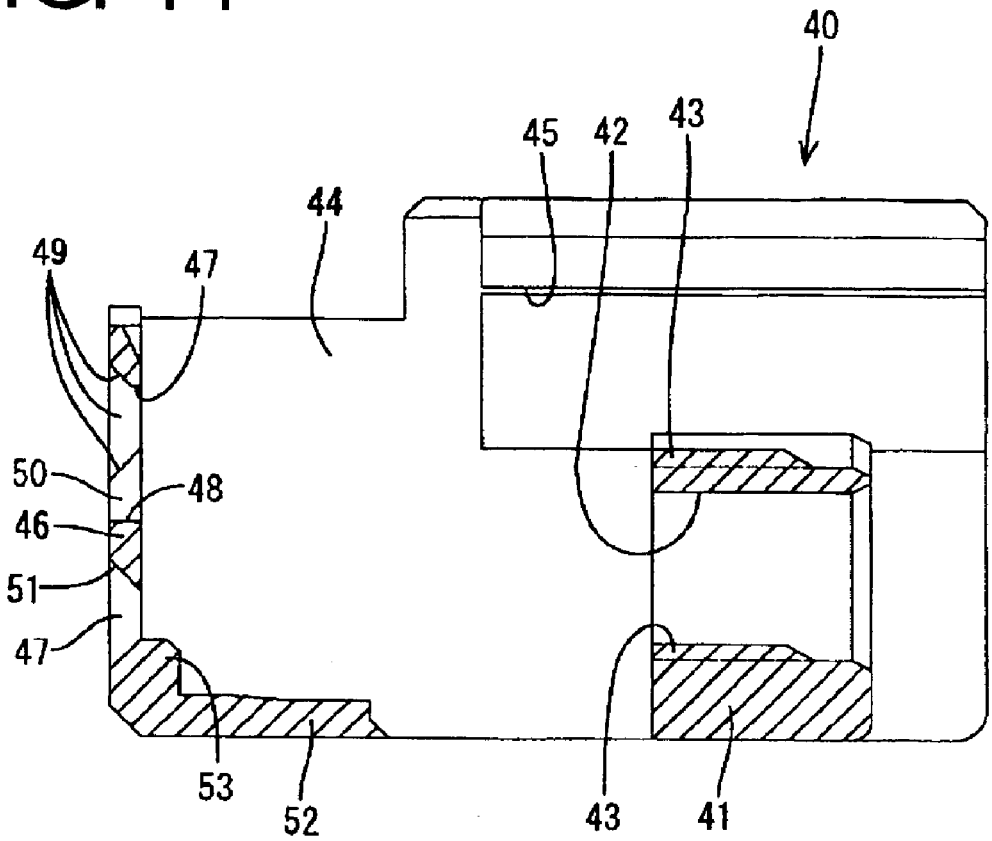
FIG. 14 is a bottom view of the retainer.

The connector is assembled by first mounting the retainer 40 at the partial locking position in the housing 10. The retainer 40 is brought closer to the housing 10 from below and in the mounting direction MD. The supports 44 fit into the mounting recesses 20; the retainer main body 41 fits into the mount space 22; and the front wall 46 slides into contact with the front surface of the housing 10. The upper end of the front wall 46 moves onto the housing-side guides 15 and undergoes a slight forward resilient deformation (see FIG. 7), to mount the retainer 40 at the partial locking position.

In this state, the respective insertion openings 14 of the housing 10 are closed at least partly by the front wall 46 of the retainer 40. The mold-removal spaces 13 at the upper stage are above the upper edges of the front wall 46 and are exposed to the outside. Additionally, the mold-removal spaces 13 at the lower stage are exposed to the outside via the jig insertion openings 48 that communicate with the through holes 47 at the upper stage. Further, the through holes 47 at the upper stage engage the housing-side guides 15.

The female terminal fittings 30 are inserted into the respective cavities 11 along the forward and backward direction FBD while the retainer 40 is at the partial locking position. The inserted female terminal fittings 30 are locked by the engagement of the locks 12 with the first engaging portions 33.

The retainer 40 is moved in the mounting direction MD to the full locking position after of all of the female terminal fittings 30 have been inserted. Thus, the front wall 46 of the retainer slides along the front end surface of the housing 10. At this time, the front wall 46 is guided by the sliding contact of the guiding surfaces 16 of the housing-side guides 15 and the guiding surfaces 50 of the jig insertion openings 48. The through holes 47 of the retainer 40 substantially align with the insertion openings 14 when the retainer 40 reaches the full locking position. Additionally, the mold-removal spaces 13 at the upper stage are substantially closed by the upper end of the front wall 46, and the mold-removal spaces 13 at the lower stage are substantially closed by portions of the front wall 46 between the jig insertion openings 48 and the through holes 47 at the lower stage.

The reinforcing wall 52 engages the cut-away portion 19 of the housing 10 to close the front ends of the cavities 11 at the lower stage. Additionally, the front end surfaces of the female terminal fittings 30 in the cavities 11 at the lower stage are stopped by the bulge 53 and are prevented from further forward movement by the engagement of the bulge 53 with the accommodating portion 17. Further, the locking sections 43 of the retainer 40 engage the second engaging portions 34 of the female terminal fittings 30. In this way, the female terminal fittings 30 are locked redundantly by the retainer 40 and the locks 12.

With the retainer 40 held at the full locking position, the retainer-side guiding portions 49 are at the upper, left and right sides of the opening edges of the through holes 47 at the upper stage and the housing-side guides 15 are at the bottom sides. Thus, the tapered guides are formed over substantially the entire periphery of the opening edge of each through hole 47 at the upper stage. Accordingly, a tab of a male terminal fitting that is displaced up, down, left and/or right during insertion into the cavity 11, will be guided to the middle by sliding contact with the guides 15, 49. As a result, the displacement can be corrected and the tab can be guided to the through hole 47 and the insertion opening 14. It should be noted that the retainer-side guides 51 are formed over the entire periphery of each through hole 47 at the lower stage.

The female terminal fittings 30 can be withdrawn by first moving the retainer 40 to the partial locking position. As a result, the locks 43 disengage from the second engaging portions 34 of the female terminal fittings 30 to cancel the locking of the female terminal fittings 30 by the retainer 40. Movement of the retainer 40 also exposes the mold-removal spaces 13 forward via the jig insertion openings 48. Thus, a narrow jig (not shown) can be inserted into the jig insertion opening 48 to resiliently deform the lock 12 up and away from the terminal fitting 30, thereby canceling the locking of the terminal fitting 30 by the lock 12. The female terminal fitting 30 then may be pulled back in a withdrawing direction while maintaining the deformed state of the lock As described above, the front wall 46 has the reinforcing wall 52 substantially normal to the wall surface of the front wall 46 and extending substantially in the transverse direction TD. Thus, the front wall 46 is prevented from curving along forward and backward directions FBD.

Opposite left and right edges of the reinforcing wall 52 are coupled to the supports 44. Therefore, displacements of the reinforcing wall 52 are restricted, and deformation of the front wall 46 is prevented even more securely.

The reinforcing wall 52 is accommodated substantially completely in the cut-away portion 19 in the bottom wall 18 of the housing 10. Therefore, the reinforcing wall does not project out from the outer surface of the housing 10 when the retainer 40 is at the full locking position.

The locks 12 are at the side opposite the cut-away portion 19 in the cavities 11 at the lower stage. Thus, the reinforcing wall 52 engaged with the cut-away portion 19 does not interfere with the locks 12.

The bulge 53 partially increases the thicknesses of the front wall 46 and the reinforcing wall 52 at the corner portion where the front wall 46 and the reinforcing wall 52 join. Thus, the front wall 46 and the reinforcing wall 52 have a higher bending strength.

The bulge 53 for holding the female terminal fittings 30 at their front-limit positions in the cavities 11 at the lower stage and the locking sections 43 for locking the female terminal fittings 30 are maintained at a constant specified spacing along forward and backward directions FBD because both are formed in the retainer 40. Thus, even if the retainer 40 shakes along forward and backward directions FBD with respect to the housing 10 due to a dimensional tolerance or the like, the female terminal fittings 30 are held at their front-limit positions by the bulge 53 and do not shake forward and backward with respect to the retainer 40.

The front wall 46 has the through holes 47 substantially facing the insertion opening 14 at the upper stage when the retainer 40 is held at the full locking position and the jig insertion openings 48 face the mold-removal spaces 13 at the lower stage when the retainer 40 is held at the partial locking position. The slanted guide surfaces are formed over the entire opening edges of the through holes 47 at the upper stage by the retainer-side guiding portions 49 and the housing-side guides 15. Thus, the tabs of the male terminal fittings can be guided securely to the insertion openings 14.

The guiding surfaces 16, 50 on the housing-side guides 15 and at the opening edges of the jig insertion openings 48 are substantially parallel with the sliding direction of the front wall 46 and to the mounting direction MD. Therefore the guiding surfaces 16, 50 slide in contact with each other as the retainer 40 is displaced. The front wall 46 can be moved along a specified path by the sliding contact of these guiding surfaces 16, 50.

The surfaces of the housing-side guides 15 substantially opposite from the insertion openings 14 at the upper stage define the slanted introducing surfaces 15B that face the opening edges of the jig insertion openings 48 for the adjacent cavities 11 at the lower stage. Thus, the jig can be securely inserted into the jig insertion opening 48.

The invention is not limited to the above-described embodiment, and the following embodiments also are embraced by the invention as defined by the claims. Beside the following embodiments, various changes can be made without departing from the scope of the invention as defined by the claims.

The left and right edges of the reinforcing portion are coupled to the supports in the foregoing embodiment. However, at least one of the left and right edges of the reinforcing portion may be separated from the support.

The reinforcing portion forms parts of the outer walls of the cavities in the foregoing embodiment. However, it may be placed on or near the outer surfaces of the outer walls of the cavities according to the present invention.

Although the cut-away portion in the outer wall of the housing is a window hole communicating with the cavities in the foregoing embodiment, it may be a recess that does not communicate with the cavities.

The outer surface of the reinforcing portion is substantially flush with the outer surface of the housing in the foregoing embodiment. However, there may be a step between the outer surface of the reinforcing portion and the outer surface of the housing according to the present invention.

What is claimed is:

1. A connector, comprising:

a housing with opposite front and rear ends and cavities extending into the rear end, insertion openings being formed in the front end of the housing for allowing parts of mating terminal fittings to be inserted into the cavities, a plurality of said cavities being arranged along an outer wall of the housing, the outer wall of the housing having a cut-away portion adjacent the front end of the housing and opening to the cavities arranged along the outer wall; and a retainer mountable into the housing for locking terminal fittings in the respective cavities, the retainer including a main body having locking sections engageable with the terminal fittings, a front wall supported substantially along the front end of the housing, through holes formed in the front wall and substantially corresponding to the insertion openings, at least one reinforcement projecting at an angle to the front wall and extending substantially in a transverse direction, the reinforcement being accommodated in the cut-away portion.

2. The connector of claim 1, wherein the retainer comprises two supports extending from opposite lateral sides of the main body, and the front wall spanning between front edges of the supports for locating the front wall substantially along the front end of the housing.

3. The connector of claim 2, wherein at least one edge of the reinforcement is coupled to the support.

4. The connector of claim 1, wherein a plurality of said cavities are arranged along an outer wall of the housing, each of said cavities having a lock for locking the corresponding terminal fitting, the locks being located at a side opposite from the outer wall.

5. The connector of claim 1, further comprising a bulge increasing thicknesses of the front wall and the reinforcement where the front wall and the reinforcement meet, the front wall extending substantially in the transverse direction.

6. The connector of claim 5, wherein the housing has an accommodating portion for at least partly accommodating the bulge.

7. The connector of claim 5, wherein the accommodating portion communicates with front ends of the cavities, and the terminal fittings inserted into the cavities are held at their front-limit positions by contacting the bulge accommodated in the accommodating portion.

8. The connector of claim 1, wherein the housing comprises at least one housing-side guide and the front wall comprises at least one guiding surface configured and disposed so that the front wall is guided by sliding contact of the housing-side guide and the guiding surface of the front wall as the retainer is moved.

9. The connector of claim 1, wherein the front wall includes mold removal spaces aligned with the respective locks, and wherein the through holes of the retainer substantially align with the insertion openings and the front wall of the retainer substantially closes the mold-removal spaces when the retainer is in a locking position, where the retainer locks the terminal fittings.

10. A connector, comprising:

a housing with opposite front and rear ends and opposite sides, cavities extending into the rear end along a forward and backward direction, the front end extending between the sides in a transverse direction substantially normal to the forward and backward direction, insertion openings being formed in the front end of the housing and extending into the cavities; and a retainer having an elongate main body extending in the transverse direction and being mountable into the housing for locking terminal fittings in the respective cavities, the main body having opposite sides substantially at the opposite sides of the housing, supports extending from the opposite sides of the main body, a front wall spanning between front edges of the supports and supported substantially along the front end of the housing, through holes formed in the front wall and substantially corresponding to the insertion openings, at least one reinforcement projecting at an angle from the front wall and extending in the transverse direction between the supports.

11. The connector of claim 10, wherein the cavities include a first stage of cavities arranged along an outer wall of the housing, the outer wall having a cut-away adjacent the front end of the housing, the reinforcement being received in the cut-away.

12. The connector of claim 11, wherein the cut-away exposes the first stage of cavities adjacent the front end of the housing.

13. The connector of claim 12, wherein each of said cavities has a lock for locking the corresponding terminal fitting, the locks in the first stage of cavities being located at a side opposite from the cut-away.

14. The connector of claim 12, wherein the retainer further comprises a bulge increasing thicknesses of the front wall and the reinforcement where the front wall and the reinforcement meet.

15. The connector of claim 14, wherein the housing has an accommodating portion for accommodating the bulge.

16. The connector of claim 15, wherein the accommodating portion communicates with front ends of the cavities, and the terminal fittings inserted into the cavities are held at front-limit positions by contacting the bulge in the accommodating portion.

* * * * *